United States Patent [19]

Pohlar

[11] Patent Number: 4,672,784

[45] Date of Patent: Jun. 16, 1987

[54] WALL FRAMING SYSTEM WITH AN INTERNAL WATER DEFLECTOR

[76] Inventor: Trent L. Pohlar, 319 Christina Dr., Whiteland, Ind. 46184

[21] Appl. No.: 779,887

[22] Filed: Sep. 25, 1985

[51] Int. Cl.[4] ..... E04B 1/66

[52] U.S. Cl. ..... 52/235; 52/98; 52/302

[58] Field of Search ..... 52/235, 209, 397, 302, 52/98, 395, 398, 772

[56] References Cited

U.S. PATENT DOCUMENTS

| | | | |
|---|---|---|---|
| 3,362,123 | 1/1968 | Geyser | 52/209 X |
| 3,830,029 | 8/1974 | Vance | 52/302 X |
| 4,055,923 | 11/1977 | Biebuyck | 52/302 X |
| 4,098,027 | 7/1978 | Crance | 52/98 X |
| 4,276,729 | 7/1981 | Shiga et al. | 52/209 |
| 4,280,308 | 7/1981 | Svensson | 52/98 |
| 4,304,075 | 12/1981 | Miyoshi | 52/98 |
| 4,428,171 | 1/1984 | Harbin | 52/395 X |
| 4,448,001 | 5/1984 | Whitmyer et al. | 52/302 X |

*Primary Examiner*—J. Karl Bell

*Attorney, Agent, or Firm*—Jones & Askew

[57] ABSTRACT

A wall framing system having a plurality of panels supported by a plurality of spaced and intersecting vertical and horizontal mullions with a water deflector mounted internally and continuously of the length of the horizontal mullions in a channel defined therein and into the intersection of the vertical mullion providing a sealing arrangement such that infiltrated water may not pass the deflector and is directed to the exterior. The water deflector is severably connected to an end panel along a tear line.

5 Claims, 16 Drawing Figures

WALL FRAMING SYSTEM WITH AN INTERNAL WATER DEFLECTOR

TECHNICAL FIELD

The present invention relates to a wall framing system, and more particularly, relates to a metal wall framing system with an internal water deflector.

BACKGROUND OF THE INVENTION

Wall framing systems consisting of glass or metal panels supported by aluminum framing elements are well known. The framing elements of such systems (e.g. mullions, sills, jambs, etc.) are often provided in two sections: an interior or "gutter" section and an exterior or "face" section. These two sections are joined conventionally by one or more connector clips that, together with the interior and exterior framing sections, support the metal or glass panels.

A common problem with such wall framing systems is water that seeps into, condenses within or otherwise infiltrates the core of the framing elements. The potenital damage presented by such water is well known, and its disposal is widely recognized as necessary to the successful maintenance of the wall framing system. Water that has infiltrated an exterior section of a framing element is easily disposed of through weep holes and the like that discharge such water to the exterior of the building. However, water that has infiltrated the interior section of a framing element is a much more difficult problem. Disposal of this water must be accomplished without any discharge or leakage into the interior of the building. Instead, this water must be directed from the interior framing element section to the corresponding exterior framing element section for disposal therefrom.

Various arrangements have been provided in the prior art purporting to solve this problem. For example, U.S. Pat. No. 4,055,923 discloses a Z-shaped flashing member mounted within the core of the horizontal mullions for diverting water from the interior mullion section to the exterior mullion section. The flashing member is mounted by screws, rivets or adhesives. Internal bridge pieces are provided at the crossings of the vertical and horizontal mullions that extend through the vertical mullions so as to connect the water diverter in one horizontal mullion to the water diverter in another.

As a further example, U.S. Pat. No. 4,448,001 discloses a moisture control dam system wherein certain mullion walls are provided with thickened ribs on their inside surfaces to seal around the edges of the outside faces of the panels. A pair of vertical grooves are formed within each such rib. Vertical dams made of a sheet material are inserted into these grooves to dam up any accumulated moisture and prevent its discharge out the end of a frame element.

As a yet further example, U.S. Pat. No. 4,428,171 discloses a store-front system for buildings including a plurality of support clips located at the intersections of the horizontal and vertical mullions. A drip shield is provided. The inner edge portion of the drip shield is arranged to be supported by an ear formed integrally with and projecting downwardly of the support clip.

Several problems exist with the above and other such prior art arrangements. For example, many such framing systems require a differently sized flashing member when panels of different thicknesses are mounted within the framing elements. Because panel thickness often varies (even within the same framing system), an additional inventory of flashing members must be kept on site or otherwise available so that the correct flashing member may be provided when needed. The use of bridges or other like members to extend across the intersection of a vertical mullion and a horizontal mullion compounds this problem. Where such bridge pieces are used, an inventory of both flashing members and bridges must also be kept on site or readily available. When used in a wall framing system employing panels of differing thicknesses, additional inventories of appropriately sized flashing members and flashing members and bridges must be maintained. Not only do such additional inventories of flashing members and bridges increase the costs associated with building supplies, the very existance of differently sized flashing members and bridges pieces provides the opportunity for dealer and installer error.

Yet another problem with such prior art arrangements is that of their relative complexity. As noted above, separate bridge members have been provided in addition to the dam or flashing member. Furthermore, prior art dam members are often mounted by screws or bolts secured to the interior mullion section. Other arrangements provide for the flashing member to be mounted upon the clip that connects an interior mullion section to an exterior mullion section. While not only requiring connectors to mount the dam or flashing member, these arrangements fail to consider the small size of the mullion core within which the dam member, the mounting bolts and screws, and the connecting clips must be manipulated and secured. These difficulties are complicated by the fact that the installer must often work in a cramped space that may be several hundred feet off the ground.

Yet another problem with prior art systems is that the fitting of the dam or flashing member within the horizontal mullion must be done entirely by the installer. In such framing systems, the installer must estimate the appropriate length and width of the dam member to insure a proper fit within the mullion. The installer then notches or cuts the dam member to fit within the frame element. Because it is often done without any predetermined measuring devices, such field fitting operations enhance the potential for installation error. Because precise fitting is imperative for system performance, such field fitting operations can result in system failure.

SUMMARY OF THE INVENTION

The present invention solves the above-described problems in the prior art by providing a wall framing system with a water delfector that is easily and securely installed within the horizontal mullions of the system without use of any separate connectors or fasteners. The water deflector is readily adaptable for use with at least one other system (or portion of the same system) supporting a differently sized panel, and includes notching indicia to assist an installer in fitting the deflector to the mullion, thereby reducing the amount of field measurement and the associated potential for poor workmanship.

Generally described, a wall framing system according to the present invention comprises a plurality of panels supported by a plurality of spaced and intersecting horizontal and vertical mullions, wherein each of the mullions includes an interior section and an exterior section. Each horizontal mullion includes a water deflector received by its interior section that extends across the core of the mullion to its exterior section whereby water that has infiltrated the horizontal mullion is deflected away from the interior section to the exterior section for discharge from the system.

Described somewhat more particularly, a wall framing system according to the present invention comprises a plurality of panels supported by a plurality of spaced and intersecting horizontal and vertical mullions, wherein each mullion is formed having an interior section joined to an exterior section by a connecting clip. The interior section of each horizontal mullion defines a continuous longitudinal channel of sufficient dimension to receive and retain a water deflector in a sealing manner. Each water deflector includes at least two notching indicators; one for making an inner notch and the other for making an outer notch. Each water deflector further includes a score line whereby it may be manually adapted for use in a system or a porton of the same system supporting a differently sized panel so as to insure that the water deflector extends directly across the core of the horizontal mullion within which it is mounted.

Thus, it is an object of the present invention to provide an improved metal wall framing system.

It is a further object of the present invention to provide a universal water deflector for a metal wall framing system capable of supporting panels of varying thicknesses.

It is a further object of the present invention to provide a water deflector that is mounted internally of a framing element in a sealing manner so that water that has infiltrated the core of the framing element is discharged and prevented from infiltrating the building.

It is a further object of the present invention to provide a water deflector that is simple in construction and easily installed within a horizontal mullion without the need of tools or other conventional connectors.

It is a further object of the present invention to provide a water deflector that reduces the potential for installation error, poor workmanship, and system failure.

It is a further object of the present invention to provide a water deflector having indicators for notching and cutting the water deflector for installation within a wall framing system.

It is a further object of the present invention to provide a water deflector having a tear-away score for adapting the deflector for use in a metal wall framing system employing panels of varying thicknesses.

It is a further object of the present invention to provide a continuous water deflector that extends not only the length of a horizontal mullion, but also into the intersection of such horizontal mullion with a vertical mullion.

These and other objects, features and advantages of the present invention will become apparent from reading the following specification in conjunction with the accompanying drawings.

DETAILED DESCRIPTION

Figure 1:
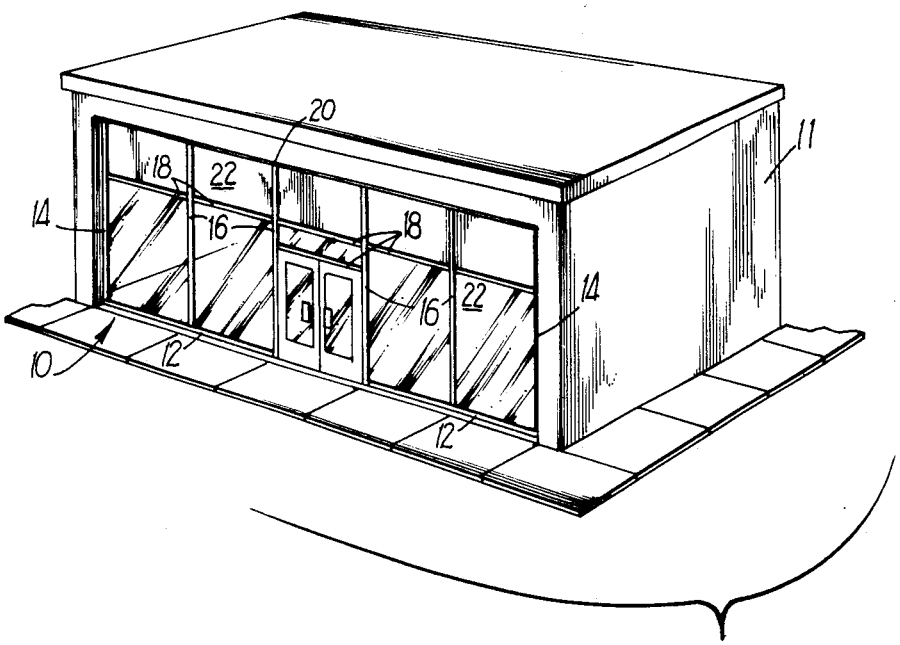
FIG. 1 is a pictorial view of a building, the front wall of which comprises a preferred embodiment of the present invention.

Referring now in more detail to the drawing, in which like numerals indicate like parts throughout the several views, FIG. 1 shows a wall framing system 10 according to the present invention provided on the front of a building 11. Those skilled in the art will recognize the wall framing system 10 to be of the "store front" type, including sills 12, jambs 14, vertical mullions 16, intermediate horizontal mullions 18, and header mullions 20. Each of these framing elements engage and thereby support an edge of a panel 22. A plurality of panels 22 are thus supported in a common plane to define the wall structure. Those skilled in the art will appreciate that similar framing elements are also utilized in a "curtain wall" framing system and, therefore, that the present invention has application to a "curtain wall" framing system.

Figure 2:
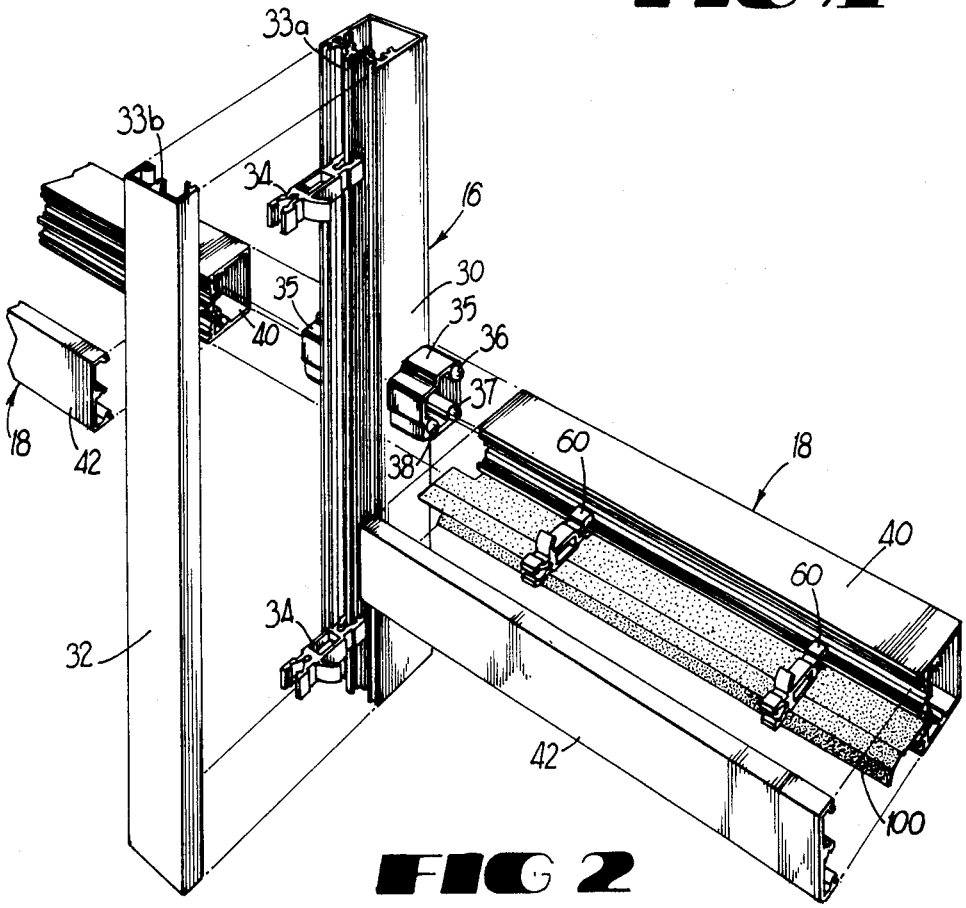
FIG. 2 is a fragmentary exploded pictorial view of an intersection of an intermediate horizontal mullion and a vertical mullion as shown in FIG. 1, showing a water deflector in one of the horizontal mullions.

FIG. 2 shows the intersection of a vertical mullion 16 and two intermediate horizontal mullions 18. The preferred vertical mullion 16 includes an interior or "gutter" section 30 and an exterior or "face" section 32, each of which is preferably an extruded profile of aluminum or any other suitable metal. The interior section 30 is generally rectangular in cross section and formed with an outwardly protruding flange 33*a* that runs the length of its outermost face. The exterior section 32 is generally C-shaped in cross section and formed with an inwardly protruding flange 33*b* that runs the length of its innermost surface. Thus, the flanges 33*a* and 33*b* face one another. To form the vertical mullion 16, the interior section 30 and exterior section 32 are connected by two clips 34. The connecting clips 34 are provided at spaced intervals and include jaw-like end clamps that engage and secure about the facing flanges 33*a* and 33*b* to form a unitary member. Such an arrangement is common to the entire wall framing system 10, and is described in greater detail hereinbelow.

Two shear blocks 35 are provided on the sides of the interior section 30 of the vertical mullion 16. The shear blocks 35 are identical in construction, and secured to the sides of the interior section 30 by screw members 36, 37 and 38. The shear blocks 35 are furthermore dimensioned for insertion into the hollow end portion of the mullions 18 so as to support each mullion in a substantially horizontal position.

FIG. 2 further shows two such intermediate horizontal mullions 18, each of which intersects with the vertical mullion 16 at the location of the shear blocks 35. Because the two intermediate horizontal mullions 18 are identical in construction, only one will be described in detail herein. The preferred intermediate horizontal mullion 18 includes an interior or "gutter" section 40 and an exterior or "face" section 42, each of which is preferably formed of aluminum or any other suitable metal. As shown best in FIG. 3, the interior section 40 is generally rectangular in cross section and defines an upper wall 45, an inner wall 46, a lower wall 47 and an outer wall 48. An integrally formed flange 50 is provided on the outer wall 48 of the interior section 40 midway between the upper wall 45 and the lower wall 47. In a manner similar to that of the flange 33*a* provided on the outer wall of the interior section 30 of the vertical mullion 16, the flange 50 protrudes outwardly of the outer wall 48 and runs continuously the entire length of the horizontal mullion interior section 40.

The exterior section 42 of the intermediate horizontal mullion 18 is generally C-shaped in cross section and defines an upper leg 52, an outer wall 53 and a lower leg 54. An integrally formed flange 55 is provided on the inside of the outer wall 53 midway between the upper leg 52 and the lower leg 54. In a manner similar to that of the flange 33*b* provided on the inner wall of the exterior section 32 of the vertical mullion 16, the flange 55 protrudes inwardly of the outer wall 53 and runs the length of the exterior section 42. Thus, the flanges 50 and 55 face one another. It is to be noted that each flange 50 and 55 is formed having a somewhat beveled key shape which, as described in greater detail below, provides a detent to facilitate joining of the interior section 40 with the exterior section 42.

The horizontal mullion 18 further includes two connecting clips 60, each of which is identical in construction to the vertical mullion connecting clips 34. The clips 60 are preferably made of plastic and include integrally formed end jaws 62 and 63 that clamp about the flanges 50 and 55, respectively. The jaw clamps 62 and 63 are configured to engage the key shaped detents of the flanges 50 and 55, respectively, thereby insuring against any separation of the clip 60 from either the interior section 40 or the exterior section 42. To provide the maximum joining effect, the clips 60 are spaced at regular intervals about the flanges 50 and 55. Because the flanges 50 and 55 run the entire length of their respective sections 40 and 42, the clips may be distributed by the installer as needed.

Two integrally formed C-shaped flanges 70 and 72 are provided at the corners of the outer wall 48 of the horizontal mullion interior section 40. Similarly, two integrally formed C-shaped flanges 74 and 76 are provided at the innermost ends of the upper wall 52 and the lower wall 54, respectively, of the exterior mullion section 42. These flanges 70, 72, 74 and 76 are configured for receipt of four glazing gaskets 78. Those skilled in the art will appreciate that because the wall framing system 10 of FIG. 1 is a "store front" type, all glazing is done from the outside prior to any installation of a panel 22. Thus, in the store front framing system, the gaskets 78 may be symmetrical in profile about their respective flanges 70, 72, 74 and 76. Those skilled in the art will further appreciate that a different gasket may be provided in a "curtain wall" system, where glazing is typically done from the inside of a structure after a panel 22 is installed. In this latter case, wedge-like gaskets (not shown) may be used to provide the desired water-tight seal. Such wedge-like gaskets and their installation are conventional and are suitable for use with the present invention.

Of course, other framing systems are known employing differeing mullion constructions. For example, a unitary mullion may be provided, thereby eliminating the need for any connecting clips or the like. As a further example, the horizontal mullions may be configured differently from the vertical mullions, or a split mullion may be provided that is secured by screw fasteners, guide pins, customized clips or otherwise. Yet in each of these systems, the problems of water infiltration and internal drainage therefrom must be addressed. Those skilled in the art will, therefore, appreciate that the teaching of the present invention, as described in detail herein, has application outside of the framing system disclosed in this preferred embodiment.

Figure 3:
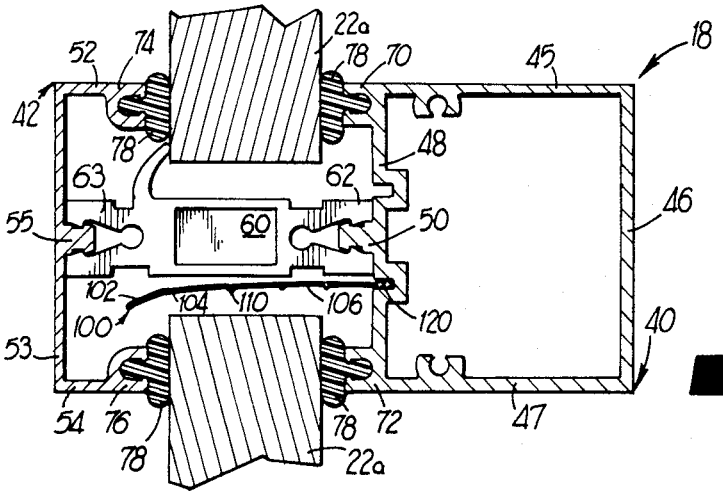
FIG. 3 is a cross-sectional elevational view showing a horizontal mullion according to the embodiment shown in FIG. 1, the mullion supporting an upper and a lower panel each of one inch thickness.
Figure 4:
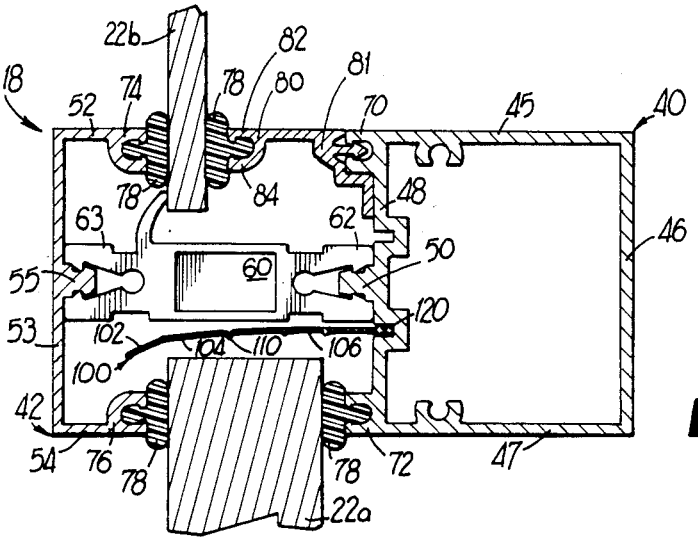
FIG. 4 is a cross-sectional elevational view showing a horizontal mullion according to the embodiment shown in FIG. 1, the mullion supporting an upper panel one quarter of an inch thick, and a lower panel one inch thick.
Figure 5:
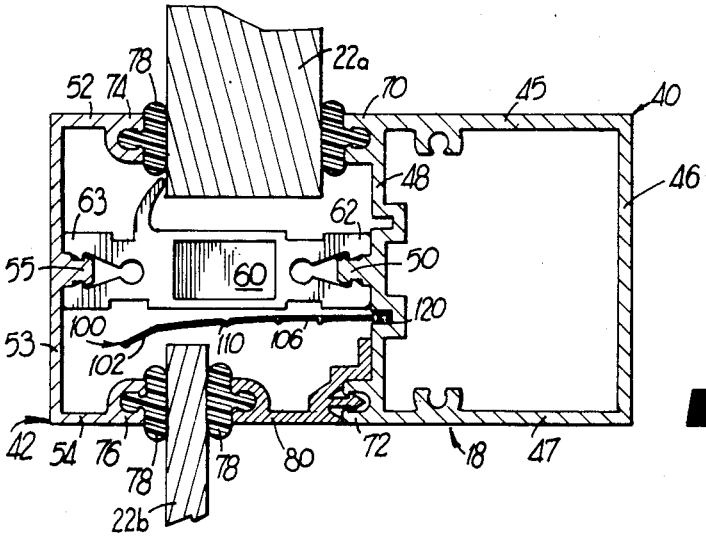
FIG. 5 is a cross-sectional elevational view showing a horizontal mullion according to the embodiment shown in FIG. 1, the mullion supporting an upper panel of one inch thickness and a lower panel of one quarter of an inch thickness.
Figure 6:
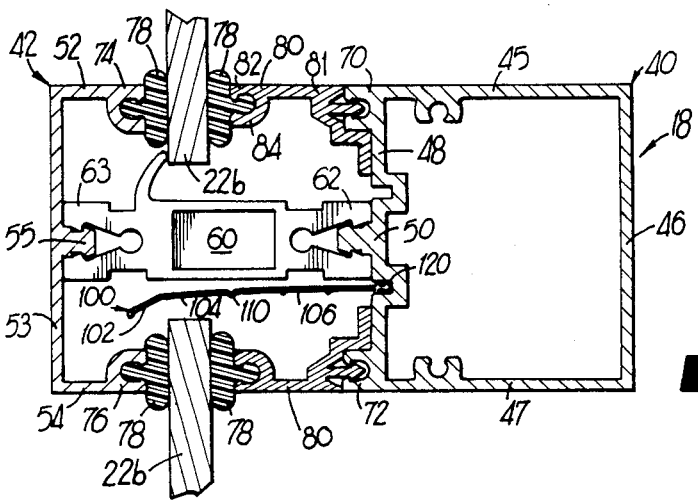
FIG. 6 is a cross-sectional elevational view showing a horizontal mullion according to the embodiment shown in FIG. 1, the mullion supporting an upper and a lower panel of one quarter of an inch thickness.

As shown in FIGS. 3 and 6, the intermediate horizontal mullion 18 may engage and support two panels 22 of equal thicknesses. The panels indicated by the reference numeral 22*a* in FIGS. 3, 4 and 5 are one inch thick. The panels indicated by the reference numeral 22*b* shown in FIGS. 4, 5, 6 and FIG. 6A are one quarter of an inch thick. Thus, as shown in FIGS. 4 and 5, the intermediate horizontal mullion 18 may also engage panels 22*a* and 22*b* of differing thicknesses. With particular reference to FIG. 4, the upper panel 22*b* is one quarter of an inch thick, whereas the lower panel 22*a* is one inch thick. With particular reference to FIG. 5, the upper panel 22*a* is one inch thick, whereas the lower panel 22*b* is one quarter of an inch thick. To facilitate these arrangements, a filler member 80 is provided between the interior mullion section 40 and the gasket 78. The filler member 80 includes an inner portion 81 configured for receipt by the upper corner gasket flange 70 of the mullions interior section 40. The filler member 80 further includes an outer portion 82 that provides a C-shaped gasket flange 84, similar to those described in detail hereinabove. The gasket 78 is then installed in the filler member flange 84 to provide the desired water-tight seal.

It is to be noted that a keeper channel 120 is provided in the outermost wall 48 of the interior section 40 of the horizontal mullion 18. The keeper channel 120, which extends the longitudinal length of the interior section 40, is described in greater detail below.

Figure 7:
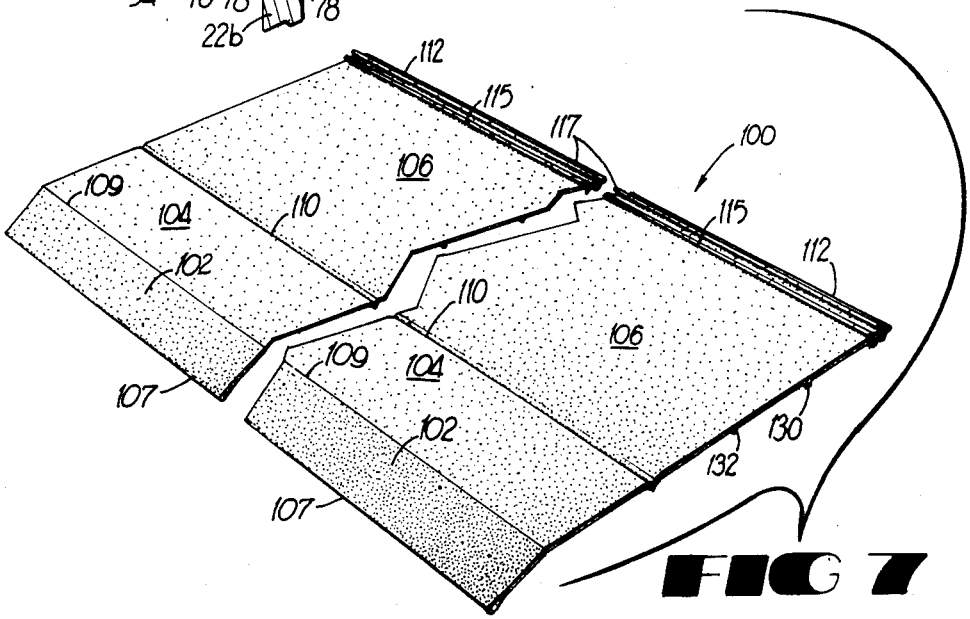
FIG. 7 is a pictorial view of a preferred embodiment of a water deflector according to the present invention.
Figure 8:
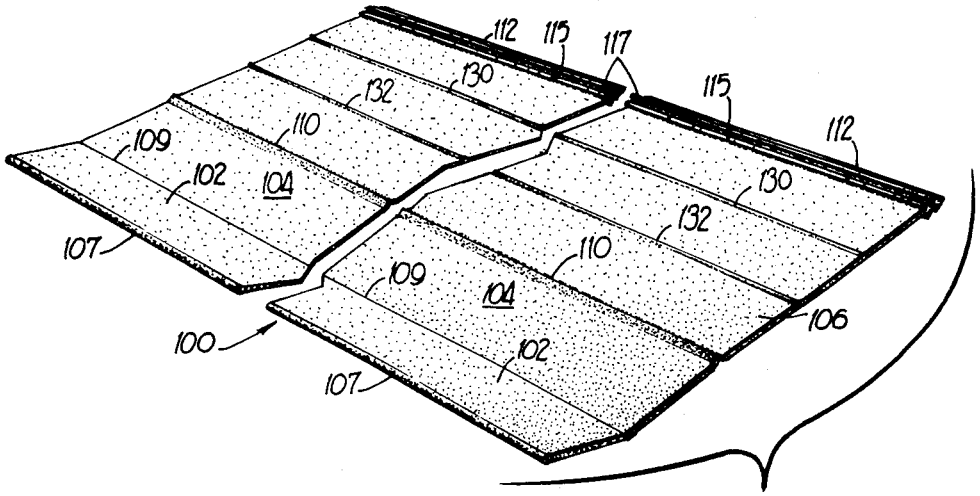
FIG. 8 is a partial pictorial view of the underside of the water deflector shown in FIG. 7.

The wall framing system 10 according to the present invention further includes a water deflector 100. As shown in FIG. 7, the water deflector 100 is formed with an end panel 102, an intermediate panel 104 and a main panel 106. The end panel 102 defines an outer deflector edge 107 and is connected to the intermediate panel 104 along a fold line 109. The effect of the fold line 109 is to create an inverted V-shaped panel construction wherein the end panel 102 is skewed downwardly of the intermediate panel 104. The main panel 106 is connected to the intermediate panel 104 along a scoreline 110, which is described in greater detail hereinbelow.

The innermost portion of the main panel 106 defines an inner water deflector edge 112. Two mounting flanges 115 and 117 are located adjacent the inner water deflector edge 112. The mounting flanges 115 and 117 are beveled away from the inner deflector edge 112 so as to project outwardly of the main panel 106 in a dendritic fashion. The mounting flanges 115 and 117 are dimensioned to be snugly received by a keeper channel 120 defined in the outer wall 48 of the interior section 40 (shown best in FIGS. 3–6). The keeper channel 120 runs the entire length of the interior section 40 at a position below the outwardly projecting flange 50 located intermediate the upper interior section wall 45 and the lower wall 47. However, the keeper channel is positioned above the upper edge of the lower panel 22*a* or 22*b*. The keeper channel 120 is formed having a sufficient depth to completely contain the mounting flanges 115 and 117 and thereby retain the water deflector 100 within the core of the horizontal mullion 18.

Thus, to install the water deflector 100, the inner deflector edge 112 is inserted manually into the keeper channel 120 until it contacts the back wall of the channel. A tool such as a putty knife may be used to insert the water deflector 100 into the keeper channel 120. The configuration of the water deflector 100 provides for the leading edge of the putty knife to engage the outermost dendritic mounting flange 115 thereof so as to wedge the deflector into the channel 120. This results in a friction fit between the beveled mounting flanges 115 and 117 and the upper and lower walls of the keeper channel 120 that secures the water deflector 100 to the interior section 40 of the horizontal mullion 18. The result of such a fit between the water deflector 100 and the interior section 46 is to create a sealing member that prevents the infiltration of any water below the level of the deflector, and directs any such infiltrated water to the exterior section 42 for discharge from the system 10 through weep holes and the like. Furthermore, no such infiltrated water can seep behind the deflector 100 and thus, the deflector cannot be avoided.

Figure 9:
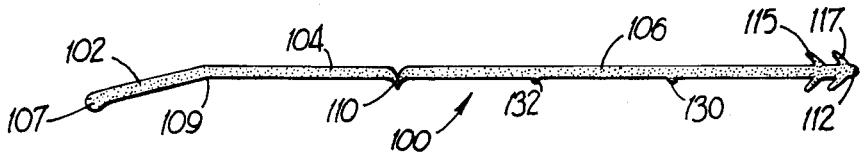
FIG. 9 is an end view of the water deflector shown in FIG. 7.
Figure 9A:
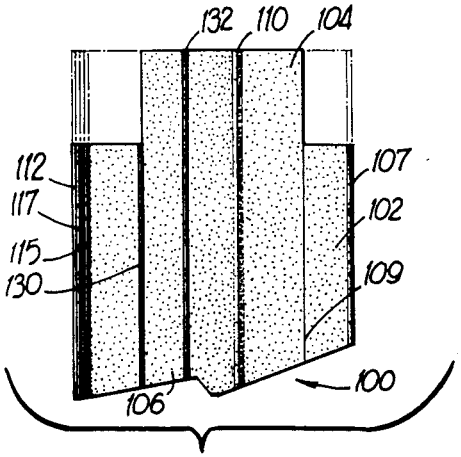
FIG. 9A is a partial top view of the water deflector shown in FIG. 7 as notched for installation in a horizontal mullion supporting one inch (1") panels.
Figure 9B:
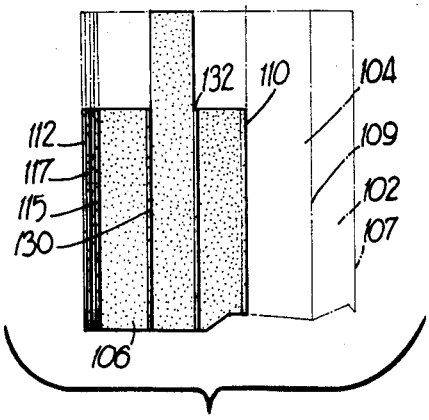
FIG. 9B is a partial top view of the water deflector shown in FIG. 7 as adapted and notched for installation in a horizontal mullion supporting one-quarter inch ($\frac{1}{4}$") panels.

The main panel 106 of the water deflector 100 further includes two notching indicators 130 and 132 (shown in FIGS. 8, 9, 9A and 9B). The notching indicators 130 and 132 run continuously the length of the water deflector 100 on the underside of the main panel 106. Indicator 130 is located nearest the mounting flanges 115 and 117. Indicator 132 is located further from the mounting flanges 115 and 117, and therefore, nearer the score line 110. Preferably, each indicator 130 and 132 is formed integrally with and projects downwardly of the main panel 106 so as to provide an abutment or stop member that prevents any notching of the water deflector 100 past the respective indicator. As described in greater detail hereinbelow, notching indicator 130 is used for making an inner notch in the deflector 100 when mounted within a horizontal mullion 18 supporting either a one-quarter inch ($\frac{1}{4}''$) thick panel or a one inch (1″) thick panel. Notching indicator 132 is used for making an outer notch in the deflector 100 for a horizontal mullion 18 supporting a one-quarter inch ($\frac{1}{4}''$) thick panel (FIG. 9B). Fold line 109 is used for making an outer notch in the deflector 100 mounted in a horizontal mullion 18 supporting a one-inch (1″) thick panel (FIG. 9A).

In accordance with the present invention, a water deflector 100 is mounted internally of each horizontal mullion 18 in the framing system 11. The inner edge 112 of the water deflector 100 is secured within the keeper channel 120 as described above. However, the outer end portions of each deflector 100 must be fitted to the intersection of the horizontal mullion 18 with the vertical mullion 16. To so fit each water deflector 100, an end portion of the deflector must be cut away or "notched" at the inner edge 112 and the outer edge 107. As a result, the remaining portion of the water deflector 100 extends across the internal opening at the intersection of the horizontal mullion 18 and vertical mullion 16.

In order to properly mount and fit the water deflector 100 in a wall framing system supporting one inch (1″) thick panels (as shown in FIGS. 2, 3, 4, 5 and 6), an inner notch is made utilizing notching indicator 130 nearest the inner edge 112 of the water deflector 100. This notch is made by making a first cut from the inner edge 112 of the deflector 100 to the notching indicator 130. A second cut is made along the notching indicator 130 from the end of the water deflector 100 that is to extend into the mullion intersection to the position of the first cut so as to complete the inner notch. The outer notch is made by making a first cut from the outer edge 107 of the water deflector 100 to the fold line 109. A second cut is made along the fold line 109 from the end of the water deflector 100 that is to extend into the mullion intersection to the position of the first cut so as to complete the outer notch. As shown in FIGS. 2 and 9A, the fold line 109 serves both to direct infiltrated water into the outer section 42 and as a notching indicator.

Once these notches are made, the water deflector 100 may be mounted properly within the keeper channel 120 so as to fit snugly against the protruding exterior section 30 of the vertical mullion 16 and extend into the internal opening of the mullion intersection. It is to be understood that the inner notch must be of sufficient length so that the water deflector 100 is fitted flush against the interior section 30. The outer notch will provide an opening for directing infiltrated water to the exterior vertical mullion section 32.

Figure 6A:
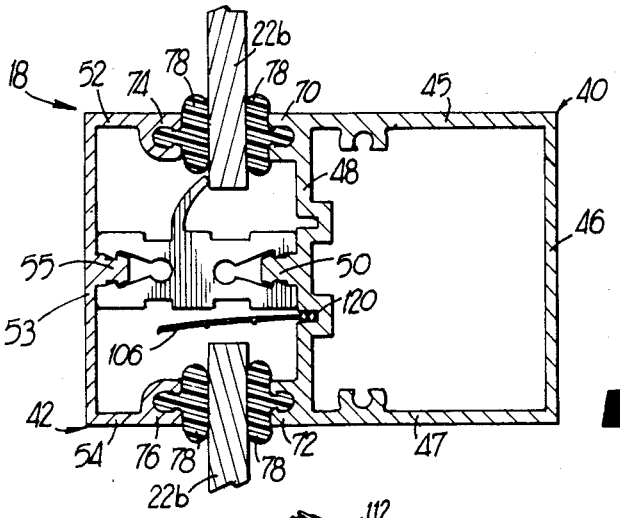
FIG. 6A is a cross-sectional elevational view showing a horizontal mullion according to the embodiment shown in FIG. 1, the mullion supporting an upper panel of one quarter of an inch and a lower panel one quarter of an inch.

A primary advantage of the present invention is that the water deflector 100 is easily adapted to a wall framing system supporting narrower panels 22, as for example, where the panels are one quarter of an inch in cross-section. As shown in FIG. 6A, such an arrangement provides for a connecting clip 60 of reduced size, yet identical in all other respects. As a result, the distance between the interior section 40 and the exterior section 42 is reduced. The water deflector 100 shown in FIGS.

Figure 10:
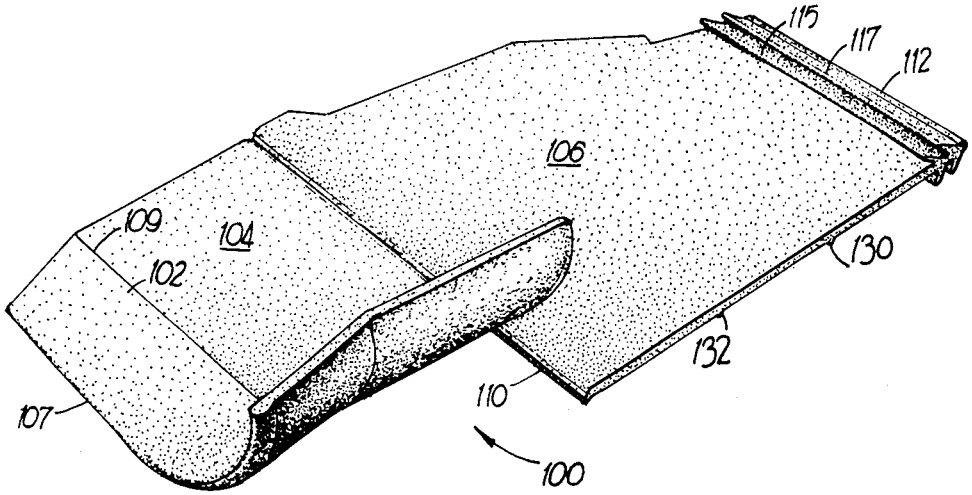
FIG. 10 is a pictorial view showing the tear-away feature of the water deflector shown in FIG. 7.
Figure 11:
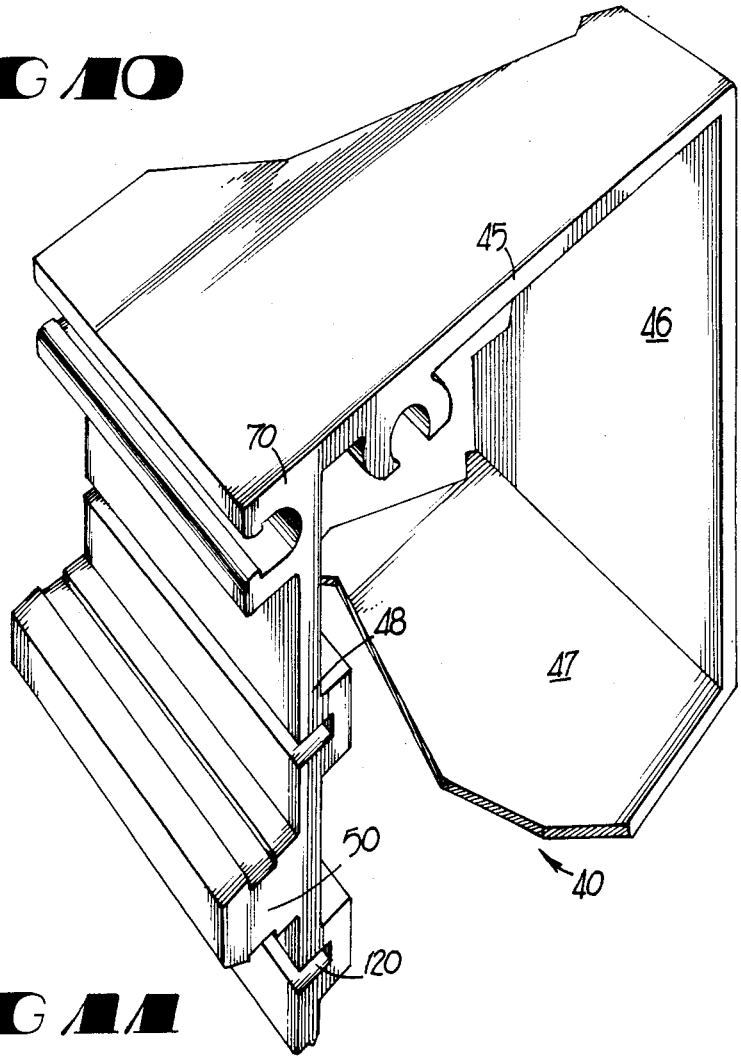
FIG. 11 is a partial pictorial view of the interior section of a horizontal mullion as shown in FIG. 1, showing the keeper channel for receipt of the water deflector shown in FIG. 7.

2, 3, 4, 5 and 6 is, therefore, too large and inappropriate for use in a wall framing system as shown in FIG. 6A. Rather than providing a separate water deflector (as is done in prior art systems), the water deflector 100 of the present invention is converted for use in such a wall framing system. To so convert the water deflector 100, the installer separates the end panel 102 and the intermediate panel 104 from the main panel 106. This is done by tearing the outermost panels 102 and 104 away from the main panel 106 along the tear line 110. As shown in FIG. 10, this is accomplished by pulling the main panel 106 away from the end panels 102 and 104, thereby ripping the water deflector into two sections along the tear line 110. Once such a tear has been made along the entire length of the water deflector 100, the outer panels 102 and 104 may be discarded. The remaining portion of the deflector 100 (the main panel 106) is mounted internally into the keeper channel 120 as described hereinabove.

When installing the converted deflector 100, the notching indicator 130 is again utilized. In a manner similar to that described above, the installer cuts the water deflector 100 from the inner edge 112 to the notching indicator 130, and then along the notching indicator 130 to the edge of the deflector. An outer notch is also made. As shown best in FIG. 9B, the outer notch is made by cutting first inwardly from the score line 110 to the notching indicator 132, and then cutting along the notching indicator 132 to the edge of the water deflector 100. The converted water deflector 100 is mounted internally of the horizontal mullions 18 as described above. It is to be noted that, in the same manner as described for a wall framing system supporting one inch panels, the converted water deflector 100 extends into the intersection a horizontal mullion 18 and a vertical mullion 16 so that any water falling downwardly through the vertical mullion will be diverted onto the main panel 106 of the water deflector 100. Thus, any water that has infiltrated the framing system at the location of a mullion intersection will be directed and deposited to the exterior vertical mullion section 32. Of course, any water that has infiltrated the central core portion of a horizontal mullion 18 will be directed and deposited to the exterior section 42 and discharged from the system through weep holes or the like.

Figure 12:
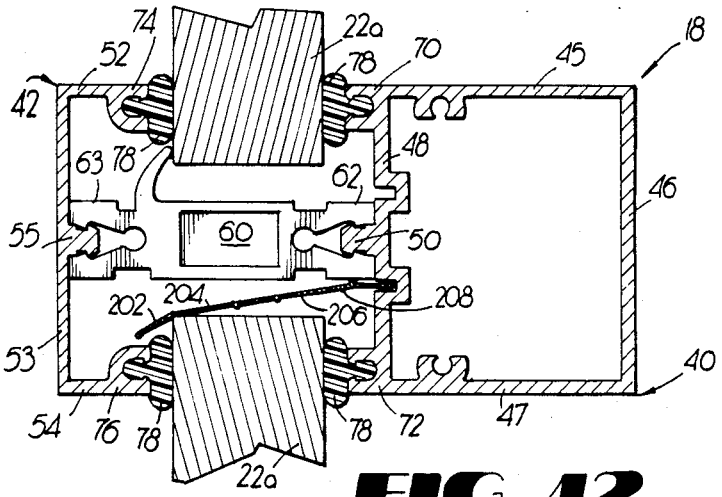
FIG. 12 is cross-sectional elevational view showing a horizontal mullion as seen in FIG. 3 with an alternative water deflector.
Figure 13:
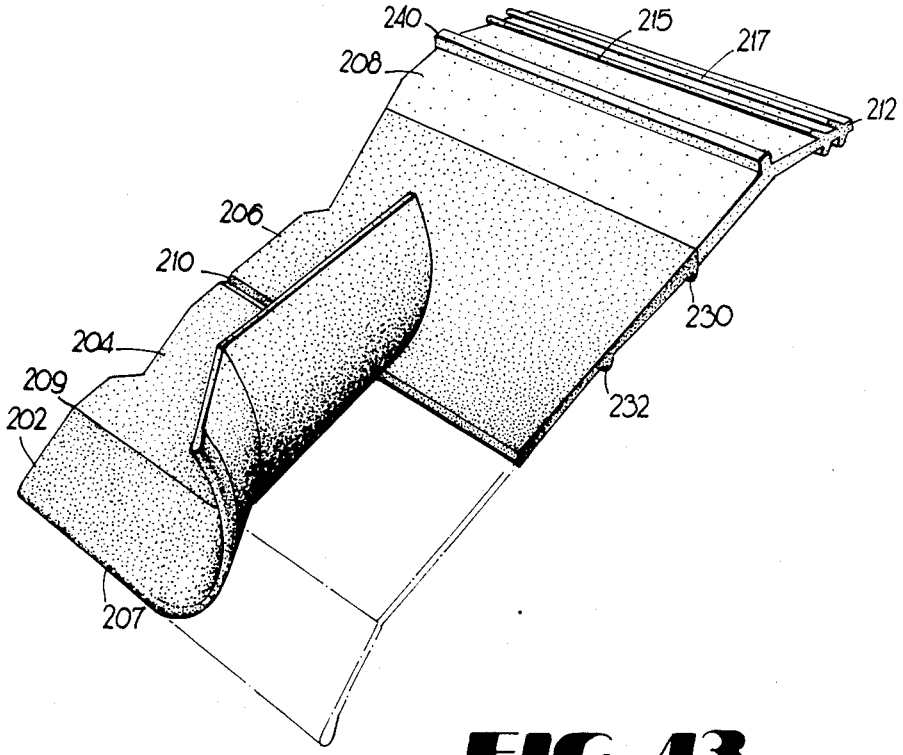
FIG. 13 is a pictorial view showing the tear-away feature of the alternative water deflector shown in FIG. 12.

An alternative water deflector 200 is shown in FIGS. 12 and 13. The water deflector 200 provides an end panel 202, an intermediate panel 204, a main panel 206 and an innermost semi-rigid section 208. The end panel 202 defines an outer edge 207 and is connected to the intermediate panel 204 along a fold line 209. In a manner substantially identical to that of the fold line 109 of the previously described water deflector 100, the effect of the fold line 209 is to create an inverted V-shaped panel construction wherein the end panel 202 is skewed downwardly of the intermediate panel 204. The main panel 206 is connected to the intermediate panel 204 along a scored tear line 210. In a manner substantially identical to that of the tear line 110 of the previously described water deflector 100, the main panel 206 can be torn away from the end panel 202 and the intermediate panel 204 so as to convert the alternative water deflector 200 for use in a framing system supporting quarter-inch panels **22*b* without the use of any extension member 80. Thus, it will be understood that the water deflector 200 shown in FIG. 12 has been mounted within a horizontal mullion 40 supporting one inch panels 22*a***.

The innermost semi-rigid section 208 defines a inner deflector edge 212. A pair of dendritic mounting flanges 215 and 217 are provided and thus, the mounting flanges are beveled away from the inner deflector edge 212. The mounting flanges 215 and 217 are dimensioned to snugly received by the keeper channel 120 defined in the outer wall 48 of the interior mullion section 40 (shown best in FIG. 12). Thus, it is to be understood that the water deflector 200 runs the entire length of the mullion section 40 at a position below the outwardly projecting flange 50 and above the upper edge of the lower panel **22*a* (or 22*b*). Although the innermost section 208 is preferably made of a semi-rigid material such as a plastic or the like, it is still flexible enough that the mounting flanges 215 and 217 are yieldingly received by the keeper channel 120 so as to create the desired friction fit. In addition, the water deflector 200 provides two notching indicators 230 and 232 that, in a manner substantially identical to that of the notching indicators 130 and 132, run continuously along the underside thereof and facilitate adaption of the water deflector to the mullion 40. As such, the alternate water deflector 200 may be mounted in a manner substantially identical for the previously described water deflector 100**.

It is to be noted that the innermost section 208 includes an upwardly projecting protrusion 240 that, when the deflector 200 is installed, contacts the lower surface of the interconnecting clip 60. This not only serves to better position the water deflector 200 within the mullion core, it insures that the panels 202, 204, and 206 are skewed downwardly and that any infiltrating water is directed to the exterior horizontal mullion section for discharge from the framing system.

Thus, it is seen that a wall framing system according to the present invention enjoys many advantages over prior art systems. In particular, the wall framing system of the present invention provides a streamlined and straightforward water deflector 100 that can be easily installed without need of any separate connectors such as screws, bolts and the like. The friction fit mounting arrangement provides an increased efficiency in the constructing of either a "store front" or a "curtain wall" framing system in terms of less time, less effort, and less support tooling. Furthermore, the insertion of the water deflector 100 into the keeper channel 120 provides a sealing arrangement along the entire length of a horizontal mullion in a manner unlike anything known in the prior art. The effect of this sealing arrangement is to insure that no water may pass below the water deflector.

The present invention further provides a single water deflector that is readily adapted to varying framing constructions. The inverted V-shaped construction of the water deflector 100 provides a sure delivery of infiltrated water to the exterior horizontal mullion section 42. The notching indicators 130 and 132 and the fold line 109 not only insure an accurate and tight fit of the water deflector 100 within the horizontal mullion, but reduce the fitting requirements placed on the installer and, therefore, reduces the associated potential for poor workmanship. The tear away capability of the present water deflector 100 eliminates the need for additional deflector inventories and the costs of producing such additional inventories. Additionally, the ability to convert a single deflector to at least one other framing system significantly reduced the opportunity for dealer and installation error. As such, the present water deflector represents a substantial improvement over those shown in the prior art.

While this invention has been described in detail with particular reference to the preferred embodiments thereof, it will be understood that variations and modifications can be effected within the spirit and scope of the invention as described hereinbefore and as defined in the appended claims.

I claim:

1. A wall framing system comprising:

a plurality of panels supported by a plurality of spaced and intersecting vertical and horizontal mullions;

a water deflector mounted internally of each horizontal mullion, each of said water deflectors running continuously the length of said horizontal mullion and extending into the intersection of said horizontal mullion and said vertical mullion;

means along the interior section of each of said horizontal mullions for receiving said water deflector, wherein said means for receiving said water deflector comprises a keeper channel in each of said horizontal mullions, said keeper channel running the length of said horizontal mullion; and means for securing said water deflector within said keeper channel, wherein said securing means comprises at least one mounting flange beveled away from said inner edge so as to project outwardly therefrom, whereby said mounting flange fits snugly within said keeper channel to retain said water deflector within said horizontal mullion, thus providing a continuous sealing arrangement such that infiltrated water may not pass below said water deflector and is directed to the exterior of said mullion.

2. The wall framing system of claim 1 wherein said water deflector comprises a main panel severably connected to an end panel along a tear line so that said water deflector may be converted for use in another wall framing system by manually tearing said end panel from said main panel.

3. The wall framing system of claim 2 wherein said tear line is located three-fourths of an inch from said inner edge of said water deflector.

4. The wall framing of claim 1 wherein said water deflector further comprises an end panel, an intermediate panel, and a main panel;

said end panel being connected to said intermediate panel along a scoreline running continuously the length of said water deflector such that said end panel and said intermediate panel create an inverted V-shaped alignment about said fold line so that water will flow downwardly from said intermediate panel.

5. The wall framing system of claim 4 wherein said main panel is connected to said intermediate panel along a tearline running continuously the length of said water deflector and further includes at least one notching indicator whereby the dimensions of said water deflector may be altered manually by tearing said intermediate panel and said end panel from said main panel and custom fitted with a framing system by selective cutting of said deflector along said notching indicator.

* * * * *